US006957772B1

(12) United States Patent
Green et al.

(10) Patent No.: US 6,957,772 B1
(45) Date of Patent: Oct. 25, 2005

(54) AUTOMATED FARE COLLECTION SYSTEM

(75) Inventors: Julie Green, Langhorne, PA (US); Lawrence Chickola, 1162 Temple Dr., Yardley, PA (US) 19067; E. Steven Emanuel, Cedar Run, NJ (US); Alan Cruickshank, Edison, NJ (US)

(73) Assignee: Lawrence Chickola, Yardley, PA (US)

( * ) Notice: Subject to any disclaimer, the term of this patent is extended or adjusted under 35 U.S.C. 154(b) by 0 days.

(21) Appl. No.: 09/565,160

(22) Filed: May 3, 2000

Related U.S. Application Data

(60) Provisional application No. 60/162,706, filed on Oct. 29, 1999.

(51) Int. Cl.[7] ..... G07B 15/02

(52) U.S. Cl. ..... 235/384; 235/385

(58) Field of Search ..... 235/384, 385, 235/462.45, 462.46, 472.01, 472.02, 462.4

(56) References Cited

U.S. PATENT DOCUMENTS

| | | | | | |
|---|---|---|---|---|---|
| 4,555,618 | A | | 11/1985 | Riskin | |
| 4,569,421 | A | | 2/1986 | Sandstedt | |
| 5,003,472 | A | | 3/1991 | Perrill et al. | |
| 5,202,825 | A | | 4/1993 | Miller | |
| 5,334,824 | A | | 8/1994 | Martinez | |
| 5,387,784 | A | | 2/1995 | Sarradin | |
| 5,708,425 | A | * | 1/1998 | Dwyer et al. | 235/384 |
| 5,717,390 | A | * | 2/1998 | Hasselbring | 235/384 |
| 6,084,870 | A | * | 7/2000 | Wooten et al. | 370/349 |
| 6,130,626 | A | * | 10/2000 | Kane et al. | 235/384 |
| 6,246,883 | B1 | * | 6/2001 | Lee | 455/507 |
| 6,463,384 | B1 | * | 10/2002 | Kaplan et al. | 235/384 |

FOREIGN PATENT DOCUMENTS

| | | | | |
|---|---|---|---|---|
| DE | 10158464 | * | 11/2002 | G07B/15/00 |
| GB | 2035646 | * | 6/1980 | G07B/5/04 |
| JP | 2002063301 | * | 2/2002 | G06F/17/60 |

* cited by examiner

*Primary Examiner*—Daniel St.Cyr
(74) *Attorney, Agent, or Firm*—Stuart D. Rudoler

(57) ABSTRACT

A system and method for collecting ticket data from mass transportation vehicles in which conductors on each vehicle collect tickets, scan in the ticket information into readers, and the readers on each vehicle transmit the ticket information back to a central computer. In some embodiments the central computer can also transmit data, such as expected passenger lists, to the readers.

27 Claims, 7 Drawing Sheets

AUTOMATED FARE COLLECTION SYSTEM

This application claims the benefit of U.S. Provisional Application 60/162,706, filed Oct. 29, 1999.

BACKGROUND OF INVENTION

This invention relates generally to data collection systems, and more specifically to a ticket collection system for passenger mass transportation system, in the present embodiment a passenger railroad system. The invention provides for a device to assist conductors in collecting and reading passenger tickets, converting the ticket data into an electronic format, and transferring the data from the train to a central computer, where the information is made available to the railroad company for use in selling tickets and maintaining lists of passengers on trains. The invention is capable of receiving such data from multiple trains operating simultaneously.

Currently, in modern passenger rail systems, passengers carry paper tickets with them onto trains. Conductors walk through the trains after every stop and collect tickets from new passengers who have boarded the train. Many passengers purchase their tickets prior to boarding a train, either at a train station, from the train company or through a travel agent. If the passenger does not have a ticket, the conductor manually writes out or punches a ticket and sells it for cash or by credit card to the passenger. After collecting tickets from each passenger, the conductor generally issues each passenger a paper seat check that indicates the destination of that passenger. The conductor may mark the seat check by manually punching holes in it. A need exists to provide for an automated ticket collection system which reduces the manual labor involved in selling, collecting and processing tickets and generating seat checks on board a train.

One problem with the current manual process is that the train company does not have timely information about the number or identity of passengers on the train until the trip is over, the conductor turns in the tickets, and the tickets are counted and read. Even though some or all of the seats on certain trains are reserved, the train company only knows which passengers plan to be on which trains, but does not know which passengers or how many actually board each train. Also, the train company does not know how many seats on each train have actually been used, since the tickets are collected after the train leaves the station. Because the train can spend many hours between train stations, and in some cases only stopping at a given station for several minutes, many times there is no opportunity to find out how many seats are taken on a train until the train reaches its final destination, several days after its departure. This prevents timely information from being available to the train reservation system to sell empty seats for trains en route. Similarly, because the conductor on the train is isolated from the train reservation system, he or she is unaware of cancellations of seats, particularly upgraded seats (such as business class or first class), which he or she might be able to sell to passengers already on the train.

The problems described arise in part because trains typically do not have a pre-boarding stage, as is frequently found on airlines. While it would be possible to institute a pre-boarding stage, this is generally not desirable since one of the competitive advantages trains have over other forms of transportation is the quick boarding process. Typically, customers expect to arrive at the station only minutes before the train arrives, as compared with airlines where a minimum of an hour pre-arrival is often required. Also, many train stations are unmanned, making pre-boarding impractical. A system that could communicate tickets, reservation sales and seat class between trains and the train company's central computer while the train is en route is therefore desirable.

Once tickets are collected by the conductors on the trains, the conductors take the tickets back to their work area on the train and sort and count the tickets manually. The conductor retains the tickets until the end of the trip and then turns them over to an administrative office. These tickets are then manually reviewed by data processing personnel, who enter in the ticket numbers into the train company's computer system. It is not until this process is completed that the train company knows that a ticket that was previously sold has been used, or which passengers have traveled on which train. A system that could immediately recognize ticket number and enter them into the train company's computer systems without human intervention is desirable. This would give the conductors more time to attend to passenger needs, reduce the number of administrative and data entry personnel needed off the train, and increase the accuracy of the data collected.

As previously discussed, conductors sometimes sell tickets on the train by credit card. However, because the train cannot communicate with the credit card issuer, the conductor has no means of knowing whether a credit card is valid or not. This may result in the conductor selling tickets to passengers who give credit cards that have been stolen or revoked or have exceeded their credit limit. Because of this greater risk, credit card issuers typically charge higher fees for use of credit cards on trains due to the inability to detect fraud. In addition, due to delays in manual processing of credit card transactions, there is a substantial delay in receiving the funds for on-board credit card sales. A need therefore also exists for a fare collection system that can validate credit card information in a timely manner.

As the economy moves increasingly towards electronic commerce, smart cards are becoming more prevalent. Smart cards are credit card size devices with embedded integrated circuits capable of storing data. Smart cards can store electronic cash or, in the context of a train system, they can store prepaid trips and passenger data. A need, therefore, exists for a fare collection system capable of processing smart cards in lieu of paper tickets.

Another problem with the current system is that no list of passengers, typically called a passenger manifest, can be generated for any train until after a train has completed its trip. Aside from the previously discussed loss of revenue, this creates a safety hazard. In the event of a train accident, the train company is unable to determine the exact number and identity of passengers on the train for rescue workers to look for. It also makes it difficult in times of crisis for the train company to provide timely and accurate information to families of persons who may be on a train. A need therefore also exists for a system which can transfer information about passengers from the train, while it is en route, and use this information to generate a passenger manifest.

BRIEF DESCRIPTION OF THE INVENTION

The present invention provides a complete ticket collection system that is capable of reading paper or electronic tickets on a moving train, converting the ticket information to electronic data and transferring this information to a central computer for processing. A train conductor collects tickets from passengers, sells tickets and generates boarding passes using a computerized portable reader that may include a printer. The reader is capable of scanning ticket numbers from paper tickets as well as reading electronic smart cards. A vehicle computer on board each train collects data via wireless communication from the various readers being used by the multiple conductors on the train. The vehicle computer transfers this data off the train via wireless communication link to a central computer, either directly, via wireless telephone communication link, or via a network of local computers located a certain train stations. Once the information is transferred to the central computer, ticket data may be aggregated in a data base. This database may be used to update the train company's ticket sales and reservations computer. The database of ticket numbers, each identified to a specific train, may also be used to generate a passenger list for each train.

DETAILED DESCRIPTION OF THE INVENTION

Figure 1:
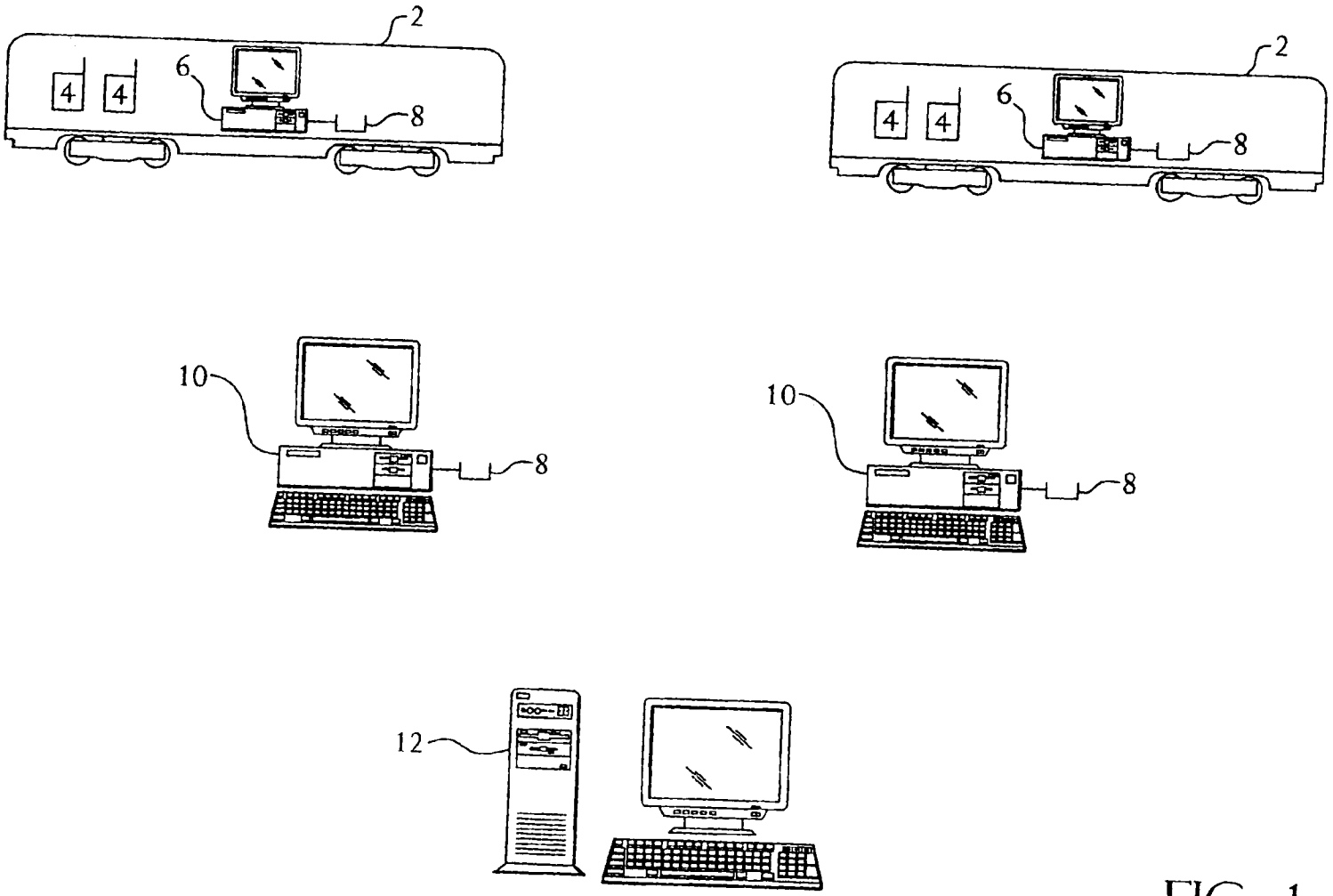
FIG. 1 is a view showing the major components of the invention.

A block diagram of the fare collection system of the present invention is shown in FIG. 1. The system is designed to collect tickets from passengers on vehicles 2 and communicate ticket data to a central computer 12 accessible by the operator of the system. In the embodiment of the invention described herein, the vehicle is a train, but the invention can be equally well implemented on other passenger mass transportation vehicles such as buses, airplanes or ships. Likewise, the data need not be ticket information, but could represent other types of information such as food, credit card, inventory, or passenger information. Further, the ticket, as described herein, could be any media able to contain data.

Typically operators of passenger trains operate large fleets of trains. Prior to boarding trains 2 passengers purchase tickets. In the present embodiment, issuance of tickets is controlled by a central reservation computer which creates a database of unique numbers for each ticket as well as the name of the passenger, origin and destination of the passenger, seat class, and if reserved, the expected date and time of travel. On each train 2, a conductor uses a reader 4 to assist in the collection of tickets.

Preferably the reader 4 should be capable of reading and automatically verifying a number of different types of tickets. Some tickets may be printed with ticket numbers or coded in bar codes. Other tickets maybe have computer readable numbers printed on them. Still others may have tickets numbers magnetically encoded. Tickets may also take the form of electronic smart cards where a certain number of trips are prepaid for on the card and the reader deducts the trips from the smart card.

In one embodiment, the reader 4 is also capable of selling tickets to passengers who have not previously purchased their tickets, and of upgrading passengers who have existing tickets. The reader 4 may also be used to accept credit or debit cards. Any type of media capable of storing data can be used as a ticket. Tickets could take the form of a hologram (optical data), magnetic card, or smart card. In one embodiment, the ticket could be a passive device known as a RF tag. When the reader 4 is held in close proximity to such a tag, the reader 4 bombards the tag with RF energy. This causes a passive device within the tag to transmit back a unique signal to the reader 4. The advantage of such a tag is that it requires no batteries, since it uses the RF energy from the reader 4 to transmit its signal. Such RF tags are well known in the art and are in common use at gas stations, parking lots and in security systems. In some embodiments of the invention the reader 4 also includes a printer 18 so that the conductor can print seat checks and sales receipts for passengers. In some embodiments, the reader 4 may store the credit card information and an image of the signature for later processing. The reader 4 may also store in its memory, a list of bad credit card numbers that should not be accepted for payment.

Figure 2:
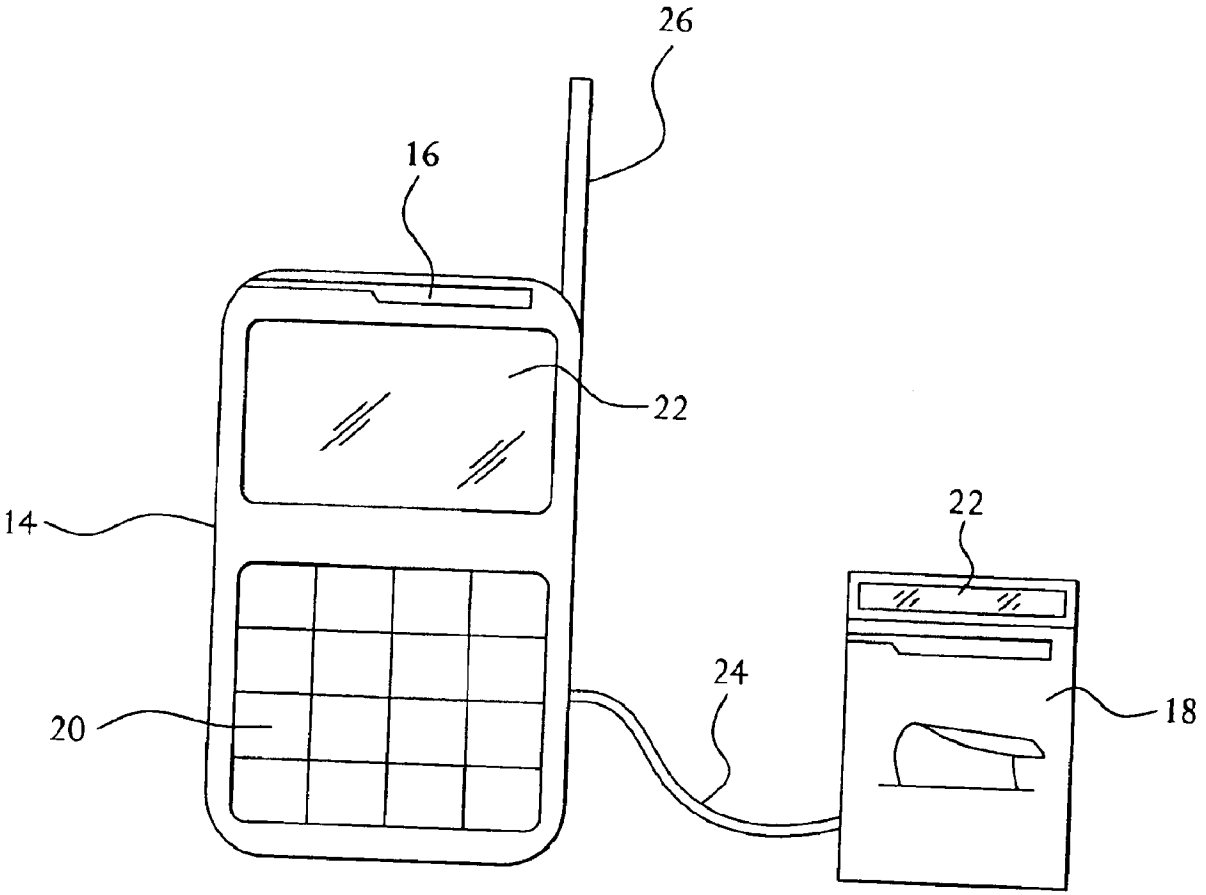
FIG. 2 is a view of the reader, including a printer.

FIG. 2 shows a typical portable reader 4 that would be used by a conductor. The base unit is a hand held unit 14 carried by the conductor. The reader 4 includes a scanner, used with bar coded tickets, for reading ticket numbers from tickets. In the present embodiment, the scanner is a small diode laser that reflects light off of the ticket and is received by an optical sensor built into the unit. An optical scanner with optical character recognition can also be used to read character-based ticket numbers. A laser capable of reading holograms or an RF transmitter/receiver may also be used to read ticket data. The reader may also have a keyboard 20 for entering numbers or letters, a display 22, and a slot 16 into which a credit card can be inserted and read. In one embodiment the hand held unit 14 is connected to a printer 18 which a conductor wears on his belt. The reader 18 may also include, a smart card reader 22, in the present embodiment built into the printer. As shown in FIG. 2, the hand held unit 14 is attached to the printer 18 via a cable 24, however, they could communicate via infrared or radio frequency signal as well. Alternatively the components of the reader 4 may be combined into one hand-held unit which could be either carried by hand or on the hip of the conductor. The reader 4 may also contain a signal transmitter and antenna 26 so that it can communicate wirelessly. Instead of or in addition to a wireless transmitter, it may communicate using an infrared signal, or a physical electrical connection. It will be obvious to those skilled in the art that the particular embodiment of the reader 4 is not critical to this invention and that many embodiments, some of which are well known in the prior art, may be used.

For trains where tickets are collected by conductors, the reader must be small and portable. In the incidence of a bus, where tickets are often collected by the driver, the reader may be mounted next to the driver and need not be portable.

Figure 3:
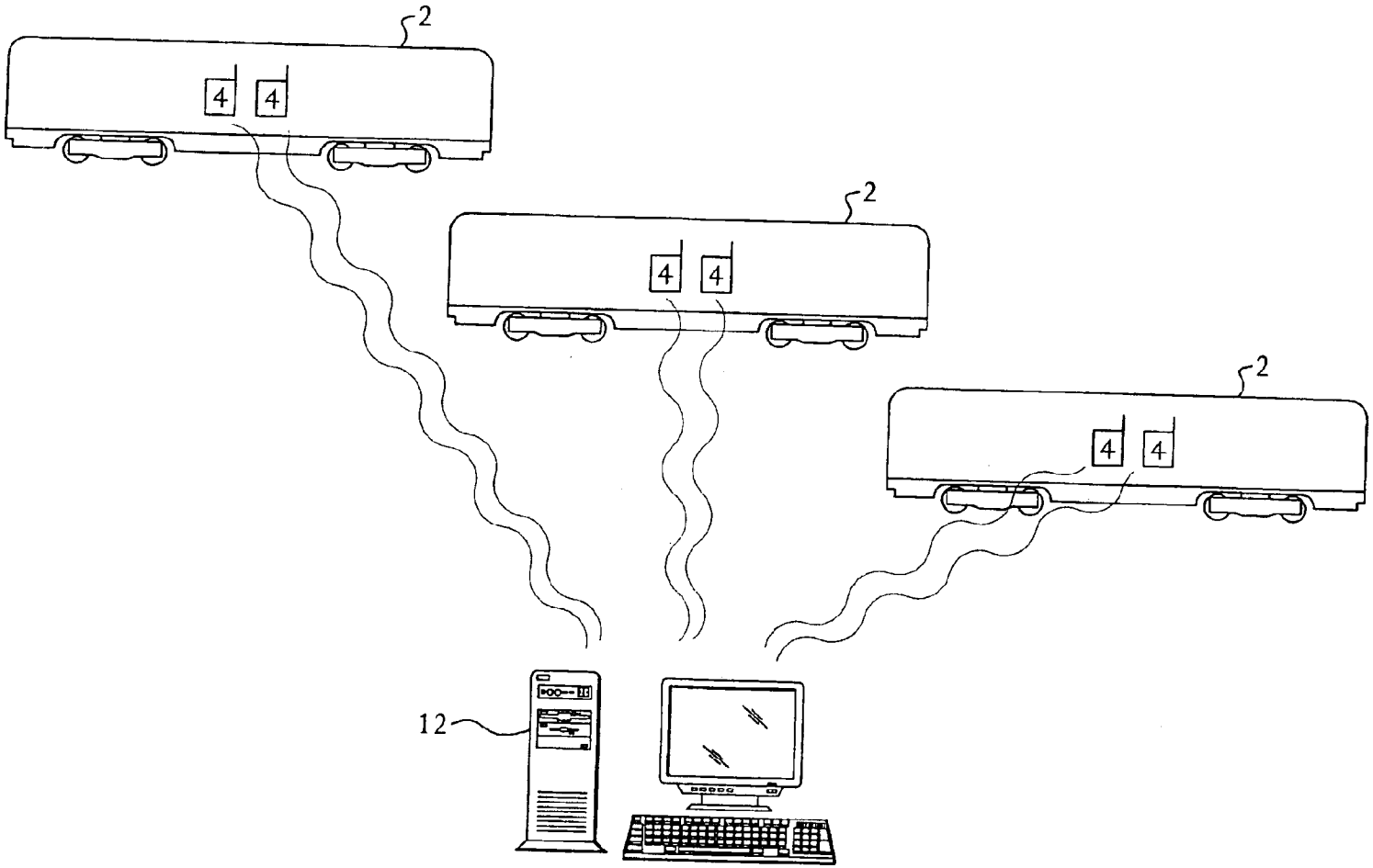
FIG. 3 is a view of one embodiment of the invention in which the readers communicate directly with the central computer.

In the simplest configuration shown in FIG. 3, the various readers 4 communicate directly with the central computer 12 which collects the data from on-board the various trains 2 and creates a data base of collected ticket numbers. The communication link can either be continuous or established on a periodic basis.

In one embodiment, as shown in FIG. 1, the system includes a vehicle computer on each train and local computers 10 at certain stations. The vehicle computer 6 is a computer dedicated to a particular train 2 that is capable of receiving data from one or more readers 4. In one embodiment, the reader 4 communicates with the vehicle computer 6 through a docking station 8. When the reader 4 is inserted into the docking station 8 data is transferred via cable from the docking station 8 to the vehicle computer 6. This embodiment requires conductors to place the reader 4 in a docking station 8 after the tickets are collected. Multiple docking stations can be provided for trains 2 with multiple readers 4. In the preferred embodiment, the reader 4 communicates with the vehicle computer 6 wirelessly. The reader 4 may communicate with the vehicle computer 6 continuously, after each transaction, after a certain number of transactions, or after a set amount of time. The vehicle computer 6 aggregates data from the multiple readers 4 on the train 2 and prepares the data for transmission off the train 2.

Multiple solutions are available to transfer the data off of the train 2 from the vehicle computer 6. In one simple configuration, the vehicle computer 6 simply writes to a removable storage medium, such as a magnetic or optical disk, all of the data collected from the ticket reading devices 4. This removable storage medium can then be inserted into a local computer 10 available at various stations along the train 2 route and at train 2 trip ends. Alternatively, a reader 4 could be used to transfer the data. In this configuration, the vehicle computer 6 would transfer, at the end of a trip, the necessary data to a reader 4, either wirelessly of through a docking station 8, and then the reader 4 can be carried off the train 2 by a conductor. The reader 4 then transfers the data to a local computer 10 in the station either wirelessly or through a docking station 8 (attached to the local computer 10). In the preferred embodiment the vehicle computer 6 senses when it comes within transmission range of a local computer 10 and transmits the date wirelessly to that local computer 10. This data transfer may be accomplished through the means of a wireless local area network at the station. Such networks are readily available and well known to those skilled in the art. One advantage of wireless transmission is that the data can be transferred even if the train 2 only stops for a few minutes, or even while the train 2 is in motion.

As stated, it is preferable that the vehicle computer 6 sense that it is within transmission range of a station and automatically transfer the data. One technique to accomplish this, known as polling, is for the vehicle computer 6 to send a test transmission at set intervals, such as once per minute. If a local computer 10 is in transmission range and receives the test signal, it can send a reply transmission, thus alerting the vehicle computer 6 to transmit data. Another technique is for the local computer 10 to continuously transmit a beacon signal. When the vehicle computer 6 receives this beacon signal it knows it is in transmission range and begins transmitting data. Other techniques are well known in the art and incorporated within the scope of this invention. Alternatively, instead of automatic data transmission, a train conductor can instruct the vehicle computer 6 to transmit data when the train 2 pulls into a station.

Figure 6:
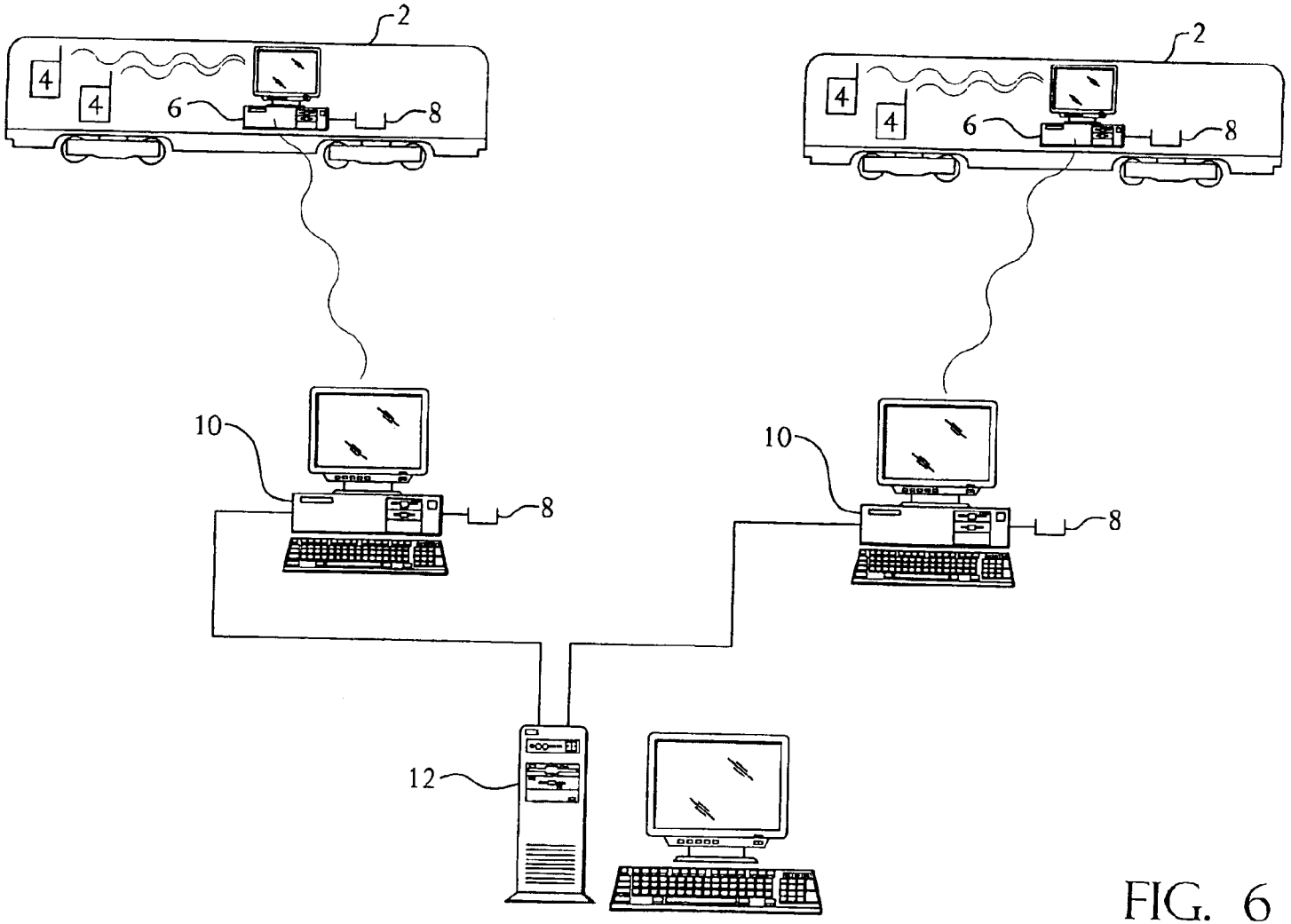
FIG. 6 is a view of one embodiment of the invention in which the vehicle computers communicate with local computers at fixed locations along the path of the vehicle, and in which the local computers communicate with the central computer via a wide area network.

The local computers 10 are designed to be local conduits to the train company's central computer 12. Local computers 10 are distributed at strategic stations throughout the transportation system. As the local computers 10 receive data from some or all of the vehicle computers 6 on board various trains 2, they store this information and transfer it to the central computer 12 over a wide area network or through traditional dial-up telephone modem, as shown in FIG. 6. Alternatively, the local computers 10 may communicate with the central computer 12 through wireless transmission such as satellite. The central computer 12 aggregates data from the various local computers 10 throughout the system and creates a data base of ticket numbers actually collected on each train. With this data base, train personnel are able to determine how many people are on each train and how many seats of which class are available for sale. By accessing this data base, sales clerks and ticket agents, and even customers, have better information about available seats.

At this point the central computer 12 can also create a passenger list for each train in the system. If the trains reservation system takes the name of each customer as it sells a ticket, then by correlating the ticket number to the purchaser, a list of each person on the train can be generated. In addition, for tickets sold by credit card, the credit card information can be accessed to identify a ticket holder. Of course smart card tickets would electronically identify card holder names. The passengers list may not be perfect, since purchasers of tickets can give the tickets to another person, but there will be at least a count of the number of passengers on each train 2.

While in the system as described, the data medium contains unique identifying information such as ticket number, in some applications this is not necessary. It may be desirable for the ticket simply to identify that a unit fare has been paid, or the destination of the traveler. In such case, the data transmitted may simply be a count of the number of tickets collected. A passenger daily commuter train or bus system might use the invention in this mode.

The invention as described heretofore, is limited in that information can only be received from a train 2 when it is near a station where there is a local computer 10. Thus, in situations where trains 2 must travel long distances between stations with local computers 10, the system operator lacks information about the number of seats available as well as the number of people on each train 2. In the preferred embodiment the vehicle computer 6 is capable of communicating with the central computer 12 even while it is traveling between stations. This can be accomplished through the addition of a wireless modem to the vehicle computer 6. These moderns, commonly available for transmission of data over cellular telephone networks deployed throughout the United States, allow the wireless transmission of data from the vehicle computer 6 to the central computers 12. Alternatively, as shown in FIG. 3, using a cellular modem, a reader 4 could transmit directly to the central computer 12 by bypassing the vehicle computer 6. Readers with such communication capability built in are now available for mobile access to the Internet, and could be easily adopted to the present invention. Indeed, in areas where wireless access to the Internet is available, the Internet can be used as a transmission medium to the central computer 12. From the point of view of the central computer 12, transmissions over the digital wireless cellular phone network are received the same way an ordinary data transmission through telephone lines would be received. The handling of the phone data transmission may be offloaded from the central computer 12 to one or more dedicated communication computers, which handle the data transmissions from the vehicle computers 6 and transfer the data to the central computer 12.

Figure 5:
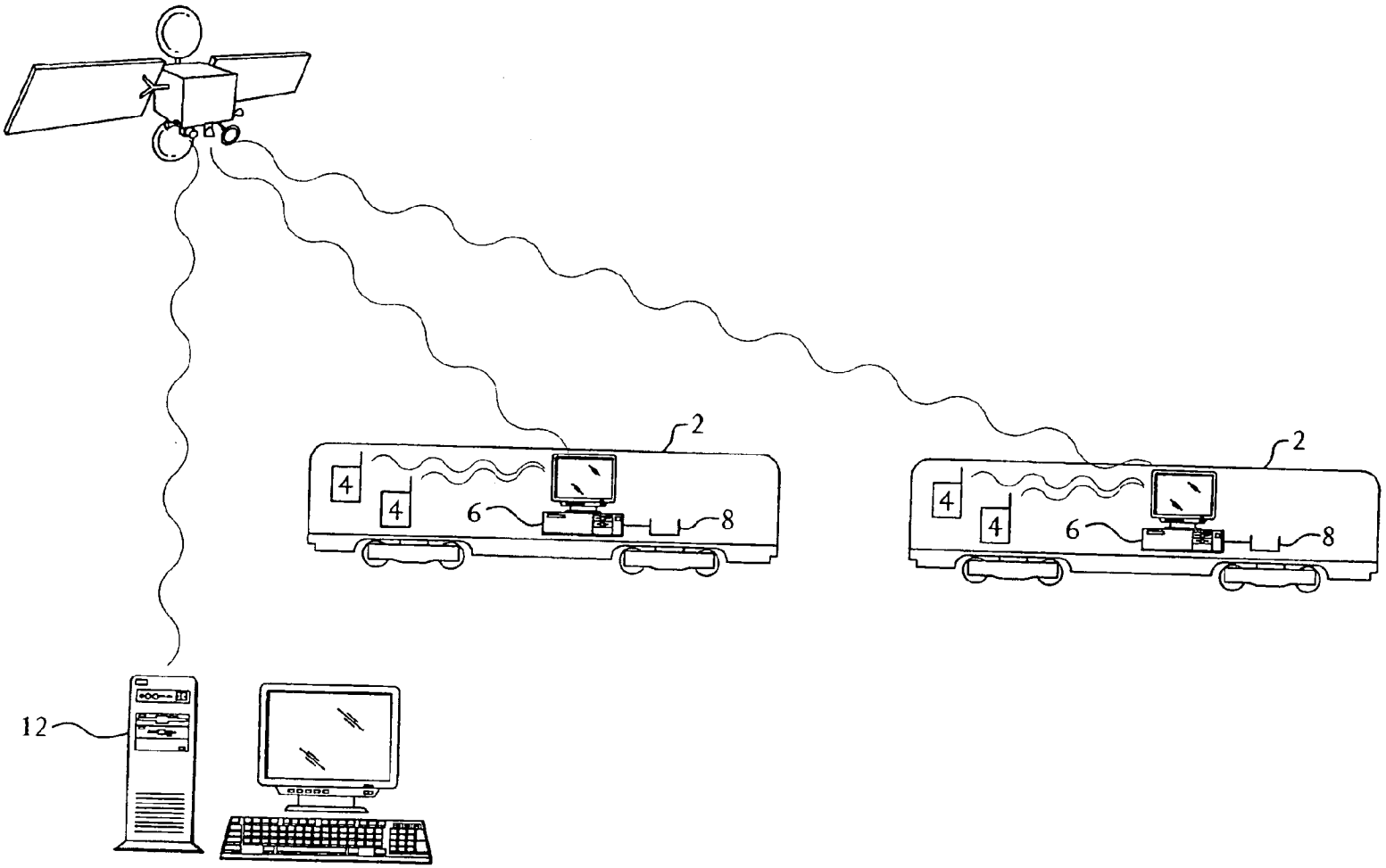
FIG. 5 is a view of one embodiment of the invention in which the vehicle computers communicate with the central computer via satellite.

In some circumstances, the trains 2 may travel and pick up passengers in areas where cellular telephone service is not currently available. In such case as, as shown in FIG. 5, vehicle computers 6 can be equipped with data modems capable of transmitting to satellite networks 26 that are capable of providing wireless data telephone coverage throughout the United States. Alternatively, direct satellite transmission could be used.

Figure 4:
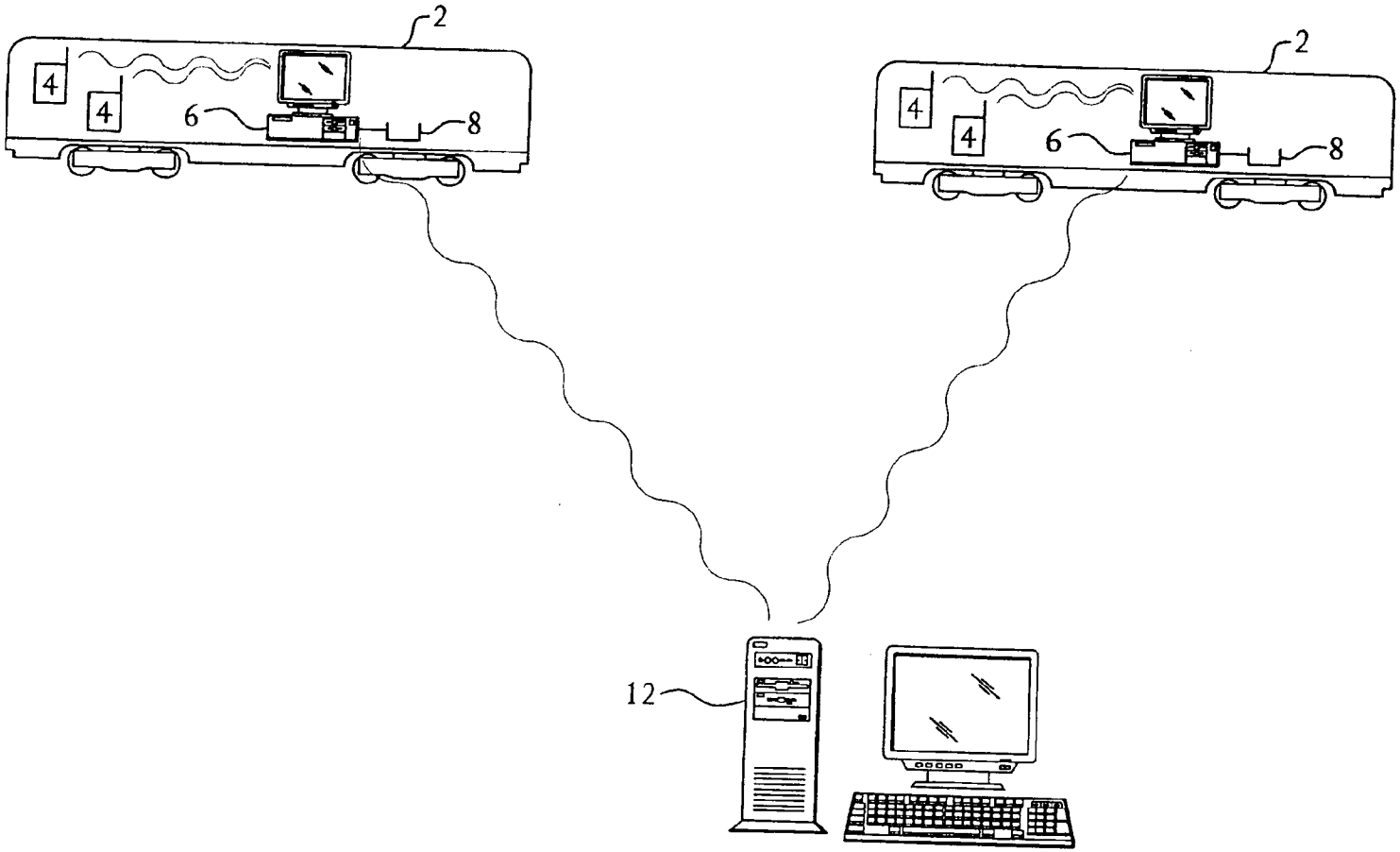
FIG. 4 is a view of one embodiment of the invention in which the readers communicate with a vehicle computer, which in turn communicate directly with the central computer.

It will be obvious to those skilled in the art that the configuration described herein is subject to many variations, and the various pieces of the system may be combined or eliminated, depending on the communication path selected. For example, in one possible configuration shown in FIG. 3, the vehicle computer 6 and station computer 10 may be eliminated and the reader 4 can be equipped with a modem so that it can communicate over a digital wireless network directly with the central computer 12. In an alternative configuration, the reader 4 can store all data until the end of the trip, at which point they dock with a local computer 10 in order to transfer data to the local computers 10 and from there to the central computer 12. Yet another alternative, as shown in FIG. 4, is to eliminate the local computers 10 and have the vehicle computers 6 communicate directly with the central computer 12. The invention claimed is meant to encompass all such embodiments and variations thereto.

The system as described contains a number of data links formed by communication means. The important feature of these links is that they create a communication path from the readers 4 to the central computer 12. Any technology for each of these communication means would be suitable and the descriptions herein are not meant to limit the technology of communication. Examples of currently available communication means are RF, infrared, laser, microwave, optical, analog cellular telephone, digital wireless telephone, wire-based telephone, physical electrical connection, fiber optics, direct satellite, telephone-based satellite, local area computer networks (hard wired and wireless), wide area computer networks (including the Internet and intranets). Other available communication means, including technologies hereafter developed, are incorporated within the scope of this invention.

The communication path developed in the claimed invention also provides the opportunity for additional beneficial functions, particularly if it is designed for bidirectional communication. For instance, the central computer 12 can download a current list of all outstanding ticket numbers through the local computer 10 to the vehicle computer 6, or alternatively, tickets that have been issued within the last week. If this information is also provided with the names of the passengers who purchased the ticket numbers, then once the conductor scans in the ticket number with the reader 4, it can provide him with the name of the passenger. A similar functionality can be provided for bad credit card numbers.

Alternatively, credit card sales can be transmitted from the train 2 at one station. The central computer 12 can validate the sales while the train is en route and transmit a list of bad sales at the next station. This would allow a train conductor to know that a credit card sale was bad while the passenger is likely to still be on the train 2. Alternatively, the reader 4 or the vehicle computer 6, could directly communicate and clear credit card sales with the credit card company in real time.

Another possible function could be to provide real time information with respect to sales at locations along the train's 2 route. This would be useful in a situation where a passenger wishes to upgrade to a first class seat, but the conductor believes he is required to hold a certain number of reserved seats for stations further on in the trip. If any of those reserved seats have been released in the interim, the central computer 12 can update the conductor's information periodically, either directly to the reader 4 or through the vehicle computer 6, so that he is able to sell the seat.

In still another use of the communication path disclosed herein, a Global Positioning Satellite receiver can be connected to the vehicle computer 6. The vehicle computer 6 can then transmit on a periodic basis the train's 2 position while en route through the wireless data modem previously discussed.

Figure 7:
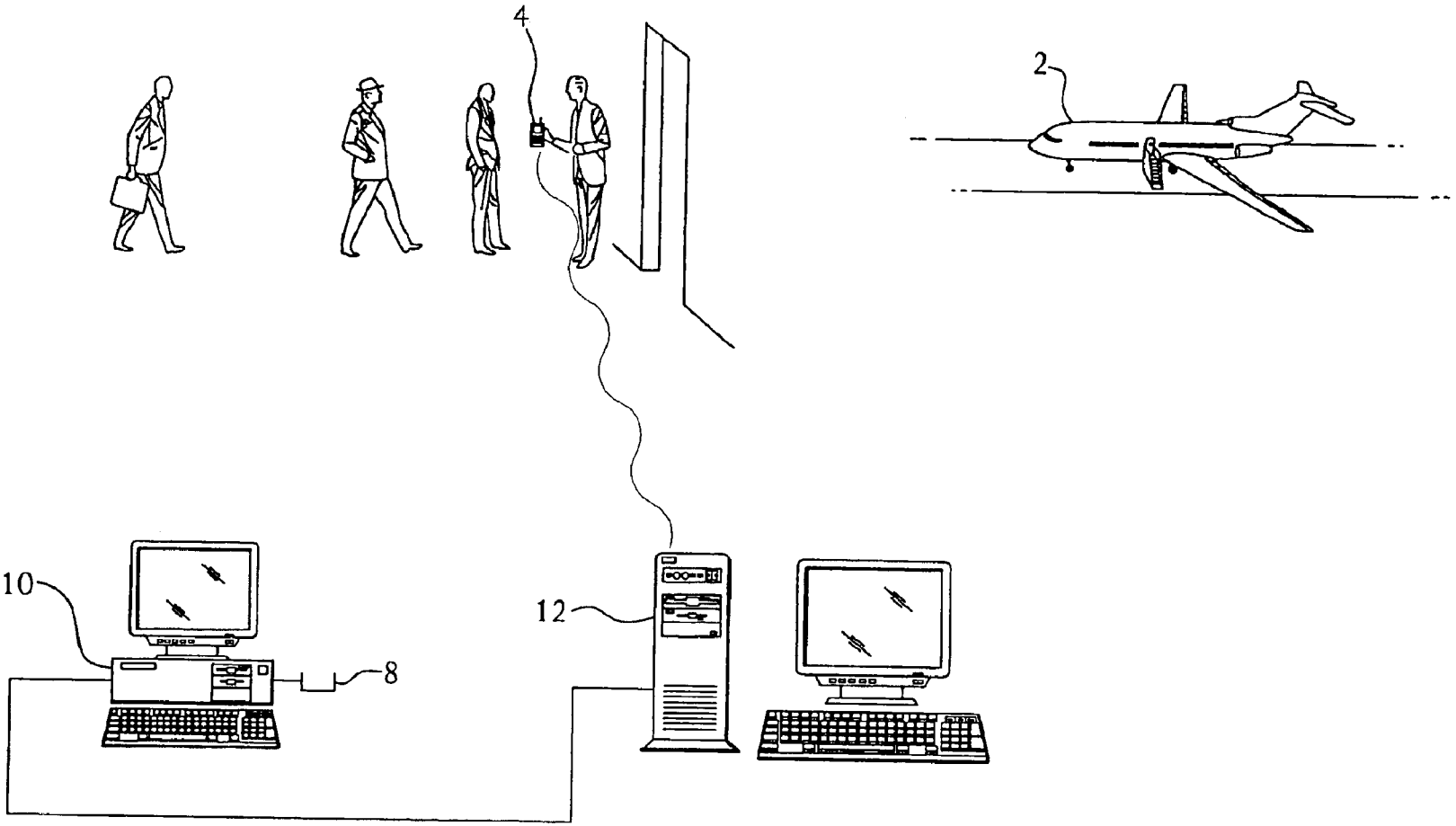
FIG. 7 is a view of one embodiment of the invention in which it is being used to preboard passengers.

The current invention can also be used to accomplish preboarding of passengers at a station as shown in FIG. 7. In this mode an attendant would collect tickets using the reader 4 as passengers boarded the train 2. Then ticket data can then be transmitted, either wirelessly or through a docking station 8, to a local computer 10, and from there on to the central computer 12. A printer can also be incorporated to print receipts or tickets. In this mode, an attendant could also sell tickets to those passengers who have not pre-purchased their tickets. Clearly, as with the other embodiments of the invention, a local computer 10 is not required, a communication could be from the reader 4 directly to the central computer 12 through any of the previously mentioned communication means. Similarly, the reader can be stationary or portable.

It should also be recognized that the invention as described is very robust in that it provides multiple communication paths. If the transmitter in a reader 4 fails, the reader 4 may dock with the vehicle computer 6. If a local computer 10 fails, the vehicle computer 6 may store the data until the train reaches the next local computer 10, or the vehicle computer 6 may transmit the data directly to the central computer 12.

It is understood that the invention is not limited to the disclosed embodiments, but on the contrary, is intended to cover various modifications and equivalent arrangements included within the spirit and scope of the appended claims. Without further elaboration, the foregoing will so fully illustrate the invention, that others may by current or future knowledge, readily adapt the same for use under the various conditions of service.

We claim:

1. A system for collecting ticket data from mass transportation vehicles comprising:

a plurality of mass transportation vehicles;

a plurality of portable media containing data on the vehicles;

a plurality of readers for reading the data from the media;

a plurality of vehicle computers for reading the data from the readers and transmitting the data from the vehicles; and a remote central computer for receiving, storing, and processing the data, in communication with the vehicle computers;

wherein at least one of the readers and at least one of the vehicle computers travels on each of the vehicles, each specific reader collects the data from the media on the vehicle on which the specific reader is traveling and transmits the data to a vehicle computer, and the vehicle computers transmit the data to the central computer.

2. The data collection system as described in claim 1 wherein the vehicles travel on predetermined routes.

3. The data collection system as described in claim 2, further comprising a plurality of local computers, each at fixed locations along the routes, and each in communication with the vehicle computers in geographic proximity to a local computer, and each in communication with the central computer, wherein data is transmitted between the vehicle computers and the central computer via the local computers.

4. The data collection system as described in claim 3 further comprising a plurality of docking stations, connected to a local computer and capable of coupling with the readers wherein data is transferred from a reader to a local computer via a docking station.

5. The data collection system as described in claim 3, wherein the local computers are located at stations where passengers embark and disembark from the vehicles.

6. The data collection system as described in claim 1 wherein the vehicles are trains, buses, airplanes or boats.

7. The data collection system as described in claim 1, wherein the media is selected from the group consisting of printed paper, electronic smart cards, magnetically encoded cards, optically encoded cards and RF tags.

8. The data collection system as described in claim 1, wherein the data represents information selected from the group consisting of ticket information, passenger information, credit card information, food information and inventory information.

9. The data collection system as described in claim 1, further comprising a plurality of docking stations, each connected to a vehicle computer and capable of coupling with the readers wherein data is transferred from a reader to a vehicle computer via a docking station.

10. The data collection system as described in claim 1 wherein data can be transferred from the central computer to a reader.

11. The data collection system as described in claim 1 wherein the readers are portable.

12. The data collection system as described in claim 1 wherein the readers include a printer.

13. The data collection system as described in claim 1 wherein the central computer processes and stores the data to create a central database.

14. The data collection system as described in claim 1, wherein the data is transferred while the vehicle is in motion.

15. The data collection system as described in claim 1, wherein data is transmitted using the technologies selected from the group consisting of radio, land-based wireless telephone, satellite-based wireless telephone, telephone land lines, direct electrical, infrared, laser, microwave, optical, local area network, and wide area network.

16. A system for collecting ticket data comprising:

a plurality of media containing ticket data;

a plurality of readers for reading the data from the media, including a first communication means;

a plurality of vehicle computers for reading the data from the readers, including a second communication means;

a remote central computer for receiving, storing and processing the ticket data, including a third communication means;

wherein each reader collects ticket data from some of the media, each reader transmits the collected ticket data to at least one of the vehicle computers, and each vehicle computer transmits the data to the central computer using the first, the second and the seem third communication means.

17. The ticket data collection system as described in claim 16, further comprising a plurality of local computers, including a fourth communication means, wherein data is transmitted between a reader and the central computer via the local computers.

18. The ticket data collection system as described in claim 17 further comprising a plurality of docking stations each connected to a local computer and capable of coupling with the readers wherein data is transferred from a reader to a local computer via the docking stations.

19. The ticket data collection system as described in claim 17, wherein the local computers are located at stations where passengers embark and disembark from the vehicles.

20. The ticket data collection system as described in claim 17, wherein the first communication means, second communication means, third communication means, and fourth communication means are selected from the group consisting of radio, land-based wireless telephone, satellite-based wireless telephone, telephone land lines, direct electrical, infrared, laser, microwave, optical, local area network, and wide area network.

21. The ticket data collection system as described in claim 16 wherein the vehicles are selected from the group consisting of trains, buses, airplanes, and boats.

22. The ticket data collection system as described in claim 16, wherein the media is selected from the group consisting of printed paper, electronic smart cards, and magnetically encoded cards, optically encoded cards and RF tags.

23. The ticket data collection system as described in claim 16 wherein data can be transferred from the central computer to a reader.

24. The ticket data collection system as described in claim 16 wherein the readers are portable.

25. The ticket data collection system as described in claim 16 wherein the readers include a printer.

26. The ticket data collection system as described in claim 16 wherein the central computer processes and stores the data to create a central database.

27. The ticket data collection system as described in claim 16, wherein the first communication means, the second communication means and the third communication means are selected from the group consisting of radio, land-based wireless telephone, satellite-based wireless telephone, telephone land lines, direct electrical, infrared, laser, microwave, optical, local area network, and wide area network.

* * * * *